United States Patent [19]

Taylor

[11] Patent Number: 4,898,002

[45] **Date of Patent: * Feb. 6, 1990**

[54] ICE MACHINE

[75] Inventor: Richard S. Taylor, Joplin, Mo.

[73] Assignee: The Manitowoc Company, Inc., Manitowoc, Wis.

[ * ] Notice: The portion of the term of this patent subsequent to Jul. 11, 2006 has been disclaimed.

[21] Appl. No.: 205,232

[22] Filed: Jun. 10, 1988.

Related U.S. Application Data

[63] Continuation-in-part of Ser. No. 150,617, Feb. 1, 1988, Pat. No. 4,845,955.

[51] Int. Cl.[4] ..... F25C 5/04

[52] U.S. Cl. ..... 62/71; 62/345; 62/353

[58] Field of Search ..... 62/66, 71, 72, 340, 62/345, 352, 353

[56] References Cited

U.S. PATENT DOCUMENTS

| | | | |
|---|---|---|---|
| 1,528,043 | 3/1925 | Bennett | 62/345 |
| 1,857,122 | 5/1932 | Sherman | 62/345 |
| 1,999,108 | 4/1935 | Osuch | 62/320 |
| 2,142,386 | 1/1939 | Tietz | 62/345 |
| 2,206,214 | 12/1935 | Chilton | 62/345 |
| 2,602,304 | 7/1952 | Randell | 62/345 |
| 2,616,271 | 11/1952 | Knowles | 62/345 |
| 2,803,950 | 8/1957 | Bayston | 62/347 X |
| 3,762,181 | 10/1973 | Leidig | 62/320 |
| 4,354,360 | 10/1982 | Fiske | 62/320 |
| 4,464,910 | 8/1984 | Stultz | 62/320 |
| 4,510,768 | 4/1985 | Keller | 62/320 |

*Primary Examiner*—William E. Tapolcai

*Attorney, Agent, or Firm*—Leydig, Voit & Mayer Ltd.

[57] ABSTRACT

A compact, efficient, and economical ice machine is provided which allows rapid production of ice chips. The preferred ice machine includes an elongated, flexible member formed as an endless loop which is rotated through a freezing tube by means of a harvesting pulley. The freezing tube includes an evaporator therearound in order to freeze water in the tube and around the flexible member portion located therein. After an ice column is formed, hot refrigerant gas passes through the evaporator to loosen the ice column from the tube interior whereupon the pulley rotates to withdraw the flexible member portion from the freezing tube and the ice column attached thereto upwardly therefrom. The ice breaking element adjacent the pulley engages the ice column and fractures it into ice chips as the flexible portion passes over the pulley.

21 Claims, 3 Drawing Sheets

ICE MACHINE

This is a continuation-in-part of my prior application Ser. No. 150,617, which was filed on Feb. 1, 1988, now U.S. Pat. No. 4,845,955.

BACKGROUND OF THE INVENTION

1. Field of the Invention

This invention relates to an ice machine of compact, efficient and economical design. More particularly, the invention relates to an ice machine having an upright freezing tube through which one leg of an endless loop of flexible material is selectively shifted upwardly. An evaporator surrounds the tube to form an ice column therein which is then withdrawn therefrom by the flexible material and broken up by the head pulley coupled with the flexible member and by an ice breaking element adjacent the pulley in order to produce ice chips.

2. Description of the Prior Art

Chips of ice for cooling fountain-dispensed soft drinks are easier to handle and allow more compact storage than larger ice cubes and are more economical to produce than crushed ice composed of much smaller particles. In designing an ice machine for producing ice chips, it is desirable for the machine to be compact, energy efficient and mechanically simple, while at the same time providing high capacity.

Prior art devices, in attempting to achieve these design goals, have met with varying levels of success. For example, U.S. Pat. No. 4,464,910 discloses a device using concentric upright freezing tubes which produce a tubular column of ice. The column of ice is discharged through the lower end of the freezing tube to engage a generally horizontal endless belt having transverse ribs which engage successive portions of the ice column in order to break the ice into smaller pieces.

U.S. Pat. No. 4,510,768 also discloses an upright freezing tube which forms a tubular column of ice. The '768 disclosure includes a piston which pushes the tubular column of ice upwardly through the upper end of the freezing tube into contact with an ice breaker which breaks the tubular ice column into smaller pieces. The known prior art ice machines, including those discussed above, tend to be mechanically more complex than desired and tend to present less than optimal mechanical efficiency.

SUMMARY OF THE INVENTION

The problems with the prior art outlined above are solved by the ice machine of the present invention. That is to say, the ice machine hereof is mechanically simple, efficient, compact, and provides high capacity for producing ice chips.

The preferred ice machine includes an upright freezing tube having an open upper end and surrounded by an evaporator for handling cold refrigerant as well as hot gas. A flexible harvesting member formed as an endless loop includes an up leg located within the freezing tube. A powered head pulley adjacent the upper end of the freezing tube shifts the harvesting member upwardly therethrough. The pulley includes a plurality of outwardly extending prongs formed in two rows to guide the harvesting ring around the pulley as it rotates and to engage and fracture the ice column as it is withdrawn from the tube. The preferred machine also includes a breaking element formed as a curved rod fixedly mounted adjacent the pulley so that the harvesting member passes therebetween and so that the element also engages the ice column to fracture it into ice chips.

After a column of ice has formed within the freezing tube, hot gas in the evaporator loosens the ice column from the interior surface of the freezing tube whereupon the pulley rotates and withdraws the ice column from the freezing tube by means of the harvesting member to which the ice column is frozen. As the ice column withdraws from the freezing tube, the pulley prongs engage the column and fracture it. The ice column is further fractured by compression between the ice breaking element and the pulley in order to form ice chips.

The preferred harvesting member is formed as a loop composed of a resilient, neoprene, "O-ring" having spaced apart annular grooves defined therein which help the harvesting loop mechanically engage the ice column for withdrawing it from the freezing tube.

BRIEF DESCRIPTION OF THE DRAWING FIGURES

DETAILED DESCRIPTION OF THE PREFERRED EMBODIMENT

Figure 2:
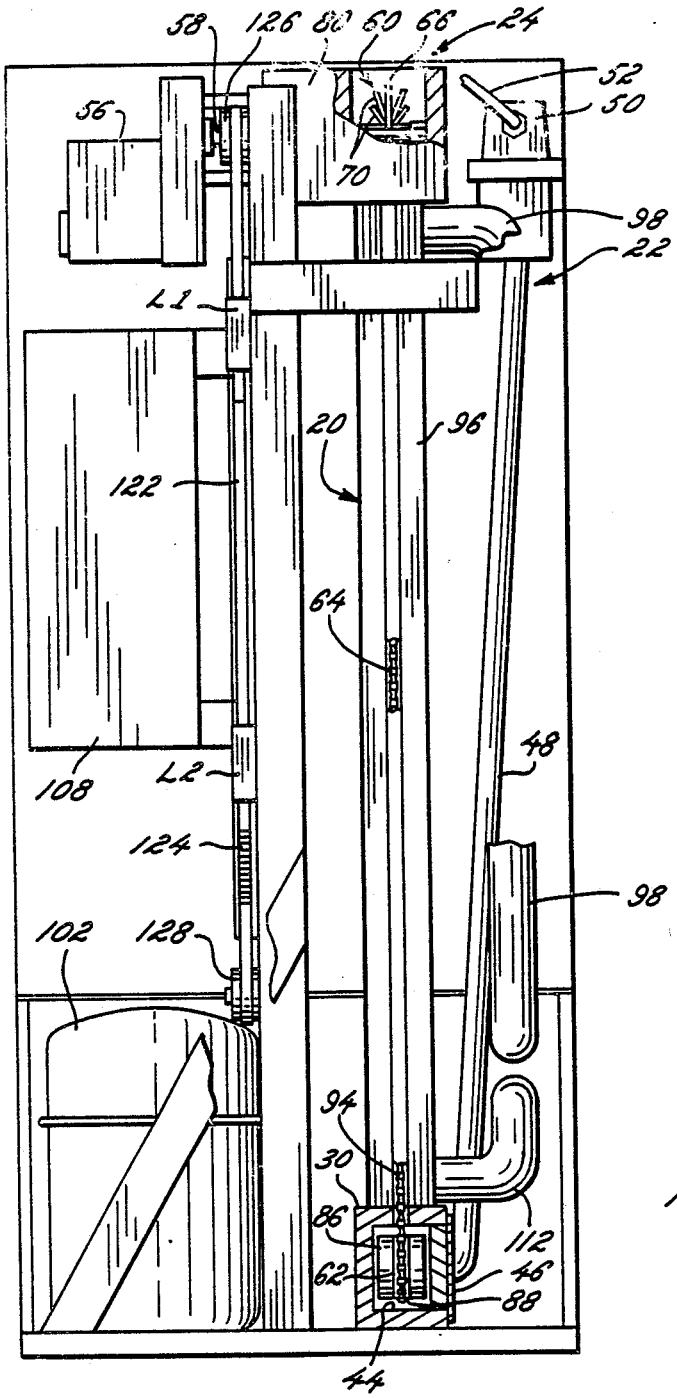
FIG. 2 is a partial elevational view in partial section of the ice producing mechanism of the ice machine with portions cut away for clarity.
Figure 1:
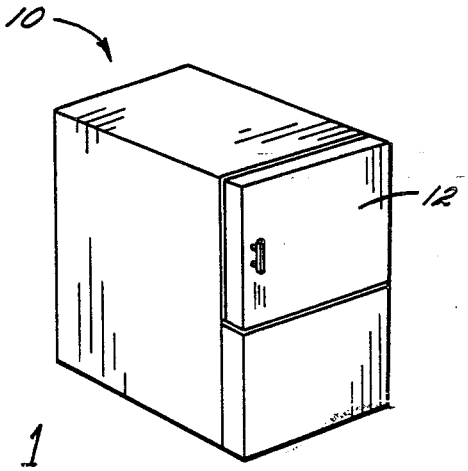
FIG. 1 is a perspective view of the preferred ice machine.

FIG. 1 illustrates the compact design of ice machine 10 which includes a conventional ice storage bin (not shown) accessible by opening door 12. The major components of ice machine 10 are enclosed in the rearward section thereof and are illustrated in FIG. 2. Broadly speaking, the major components of ice machine 10 include harvesting system 14, refrigeration system 16, and control system 18.

More particularly, ice harvesting system 14 includes ice forming structure 20, water supply system 22, and ice harvesting mechanism 24.

Ice forming structure 20 includes freezing tube 26, down tube 28, and connecting block 30.

Freezing tube 26 is preferably composed of a $\frac{7}{8}$ inch outside diameter copper tube presenting respective open upper and lower ends 32, 34 and respective exterior and interior surfaces 36, 38.

Figure 4:
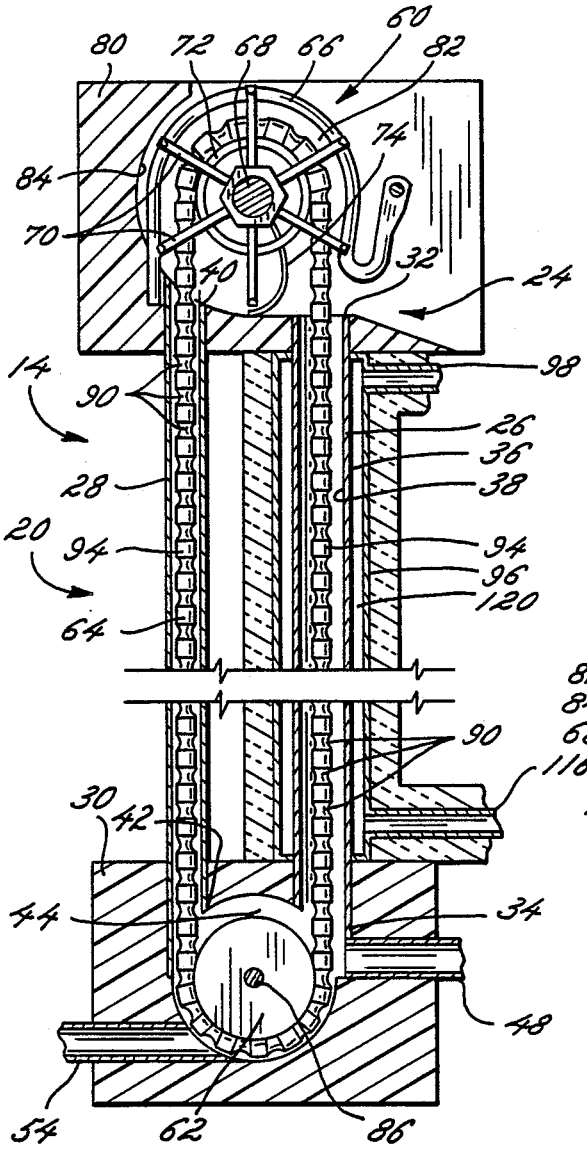
FIG. 4 is an elevational view of the ice harvesting system of the ice machine in partial section with portions cut away for clarity.

Down tube 28 is preferably composed of one-half inch outside diameter copper tube and presents respective open upper and lower ends 40, 42. Tubes 26, 28 are preferably of equal length and extend upwardly and parallel to one another from connecting block 30 as shown in FIG. 4.

Connecting block 30 is preferably composed of a synthetic resin material such as polyethylene, the walls of which are arranged to define a connecting chamber 44 therein. Connecting block 30 also includes removable end cap 46, removal of which allows access to chamber 44. Chamber 44 provides fluidic communication between tubes 26 and 28.

Water system 22 includes water supply line 48 connected to a suitable source of potable water, conventional flow valve mechanism 50 connected to water supply line 48, water inlet pipe 52 interconnecting float valve 50 and connecting chamber 44, and flush tube 54 interconnecting chamber 44 with the exterior of ice machine 10. Float valve mechanism 50 is mounted at a height just below upper ends 32 and 40 of tubes 26 and 28. When water supply line 48 is connected to a source of water, float valve mechanism 50 allows water to flow to supply line 48 through water inlet line 52 into chamber 44 and into tubes 26, 28. When the water level in tubes 26, 28 rises to the level of float valve mechanism 50, the float therein (not shown) closes the internal valve (not shown). As the amount of water in tubes 26, 28 is depleted, float valve mechanism 50 automatically replenishes the water supply to maintain the level therein.

Flush tube 54 is advantageously connected to the a solenoid operated valve (not shown) which is in turn operated by control system 18 to periodically flush chamber 44, thereby preventing or eliminating any buildup of solids which may occur during use of ice machine 10. Alternately, flush tube 54 could be provided with a manually operated valve.

Harvesting mechanism 24 includes gear motor 56, drive shaft 58, harvesting pulley 60, tail pulley 62, harvesting member or loop 64, and ice breaking element 66.

Gear motor 56 is a conventional unit preferably operating at 115 V.A.C. with an output at 12 RPM at 100 inch lbs. such as a Von Weise gear reducer Model No. VOO838AB31. Drive shaft 58 couples gear motor 56 with pulley 60 in order to drive pulley 68 at the desired output speed when activated.

Harvester pulley 60 includes a central shaft 68 connected to the end of drive shaft 58 remote from gear motor 56, six pairs of outwardly extending prongs 70, circular support ring 72 and a pair of wipers 74.

The inner ends of each pair of prongs 70 are preferably welded to a hub (not shown) pinned to central shaft 68 and are equally spaced thereabout, and extend outwardly therefrom to present a V-shaped configuration. Prongs 70 are preferably composed of stainless steel. As preferably configured, prongs 70 define a V-shaped trough surrounding shaft 68. Stainless steel support ring 72 is preferably welded within the trough defined by prongs 70 as best viewed in FIG. 4. Support ring 72 has a diameter such that it engages each pair of prongs 70 while remaining spaced from central shaft 68 as shown.

Figure 5:
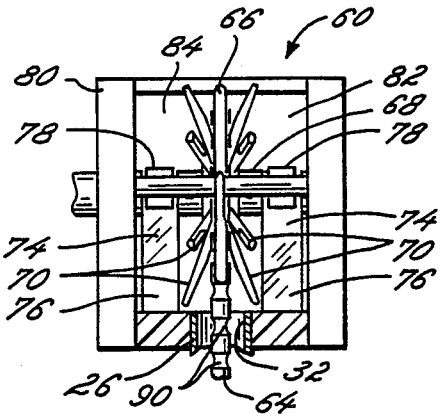
FIG. 5 is a partial elevational view of the harvesting mechanism in partial section with portions cut away for clarity.

Wipers 74 each include a rectangularly shaped portion composed of flexible, resilient, synthetic resin material and an attachment clip coupled to one end of each rectangular portion 76 in order to couple each wiper to pulley central shaft 68 on opposed sides of prongs 70 as best viewed in FIG. 5.

Head section 80 includes walls defining an ice discharge compartment 82 enclosing harvesting pulley 60. The walls of head section 80 present a curved portion 84 on the rearward side of pulley 60 which wipers 74 engage to sweep ice chips forward (to the right in FIG. 6) for discharge into the ice bin (not shown) of ice machine 10.

Tail pulley 62 is located in connecting chamber 44 and is preferably composed of synthetic resin material such as nylon. Mounting shaft 86 rotatably mounts tail pulley 62 to the interior walls of connecting block 30 for free rotation within chamber 44 as shown in FIG. 4. Tail pulley 62 also includes a circumferential, annular groove for receiving harvesting loop 64 as will be explained further hereinbelow.

Harvesting loop 64 is preferably composed of a neoprene "O-ring", the ends of which are joined by a metal clip (not shown) in order to form an endless loop. Harvesting loop 64 presents a circular cross-sectional configuration and includes a plurality of spaced apart annular transverse support grooves 90 defined on the surface thereof. Harvesting pulley 60 and tail pulley 62 support harvesting loop 64 therebetween so that loop 64 is supported on the outboard surface of support ring 72 between pairs of prongs 70 and by annular groove 88 defined in tail pulley 62. Pulleys 60, 62 support loop 64 so that it presents an up leg or harvesting portion 92 extending coaxially through freezing tube 26 and a down leg extending coaxially through down tube 28. With this arrangement, gear motor 56 by way of drive shaft 58, drives pulleys 60, 62 in a counterclockwise direction as viewed in FIGS. 4 and 6 so that harvesting portion 92 translates upwardly through freezing tube 26 and so that down leg portion 94 translates downwardly through down tube 28.

Ice breaking element 66 included as part of harvesting mechanism 24 is preferably composed of 3/16 inch stainless steel rod and formed into a semi-circular configuration as shown in FIG. 4. Ice breaking element 66 is fixedly mounted to head section 80 and spaced about ½ inch from support ring 72 between pairs of prongs 70 with harvesting loop 64 located between support ring 72 and ice breaking element 76 as best viewed in FIGS. 4 and 6.

Refrigeration system 16 includes evaporator 96, suction line 98, low pressure switch LPS, compressor 100 and motor 102, discharge line 104, high pressure fan switch HPS, condenser 108 with fan and fan motor 110, condenser discharge line 112, expansion valve 114, evaporator inlet line 116, and hot gas bypass solenoid valve 118.

In the preferred embodiment, evaporator 96 comprises a 1⅛ inch outside diameter copper tube enclosing freezing tube 26 to form an evaporator chamber 120 therebetween. The ends of the evaporator 96 are preferably silver braised to exterior surface 36 of freezing tube 26 to form enclosed evaporator chamber 120 presenting a freezing area in excess of 60 square inches. The balance of the components 98-118 of refrigeration system 16 are conventional in nature and well known to those skilled in the art. Preferably, refrigeration system 16 is designed to remove 2500 BTU at an evaporator temperature of 20° and 90° ambient temperature. A one-third horsepower compressor is preferred with a Tecumseh condensing unit Model No. AE440AA. With these design parameters, and using R-12 refrigerant, ice machine 10 can produce about 90 pounds per day of ice chips.

In general, the preferred embodiment includes refrigeration rated copper tubing and fittings, with silver braised joints using a 15% silver alloy where needed. As those skilled in the art will appreciate, evaporator 96 and the evaporator inlet line should be well insulated preferably using ½ inch Armstrong Armaflex or foam-type insulation.

Figure 8:
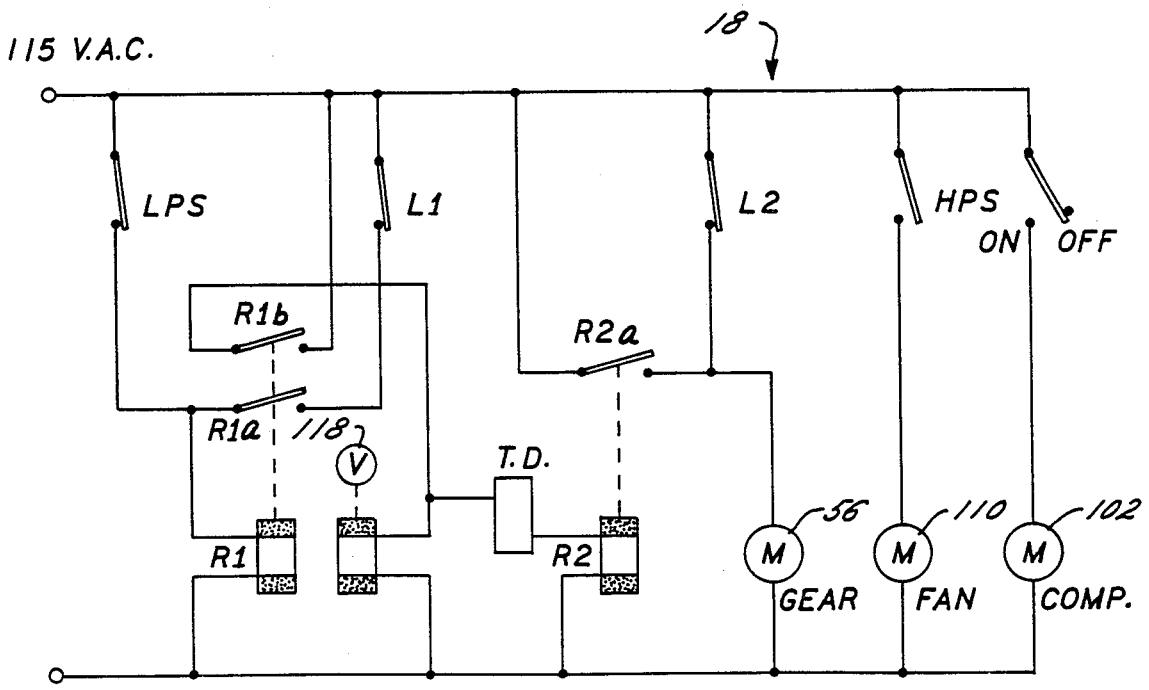
FIG. 8 is an electrical schematic of the control system.

Control system 18 preferably includes conventional components designed to operate at 115 V.A.C. Control system 18 includes cam belt 122 composed of a conventional V-belt with synthetic resin cam 124 attached to the ouboard surface thereof, upper and lower sheaves 126, 128 and upper and lower limit switches L1, L2. Control system 18 also includes a conventional electrical housing (not shown) conveniently located within ice machine 10 and including relays R1 and R2 and time delay switch TD mounted therein. FIG. 8 illustrates control system 18 in the form of an electrical schematic diagram.

Figure 3:
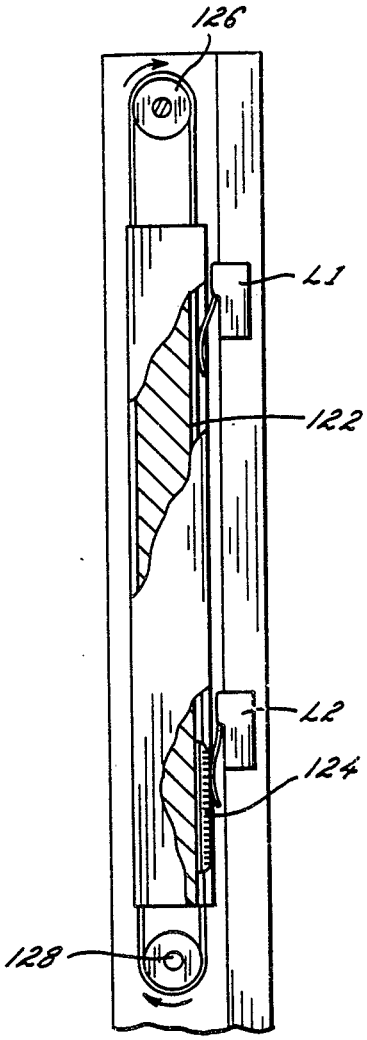
FIG. 3 is an elevational view of the cam belt and limit switches in partial section with portions cut away for clarity.
Figure 7:
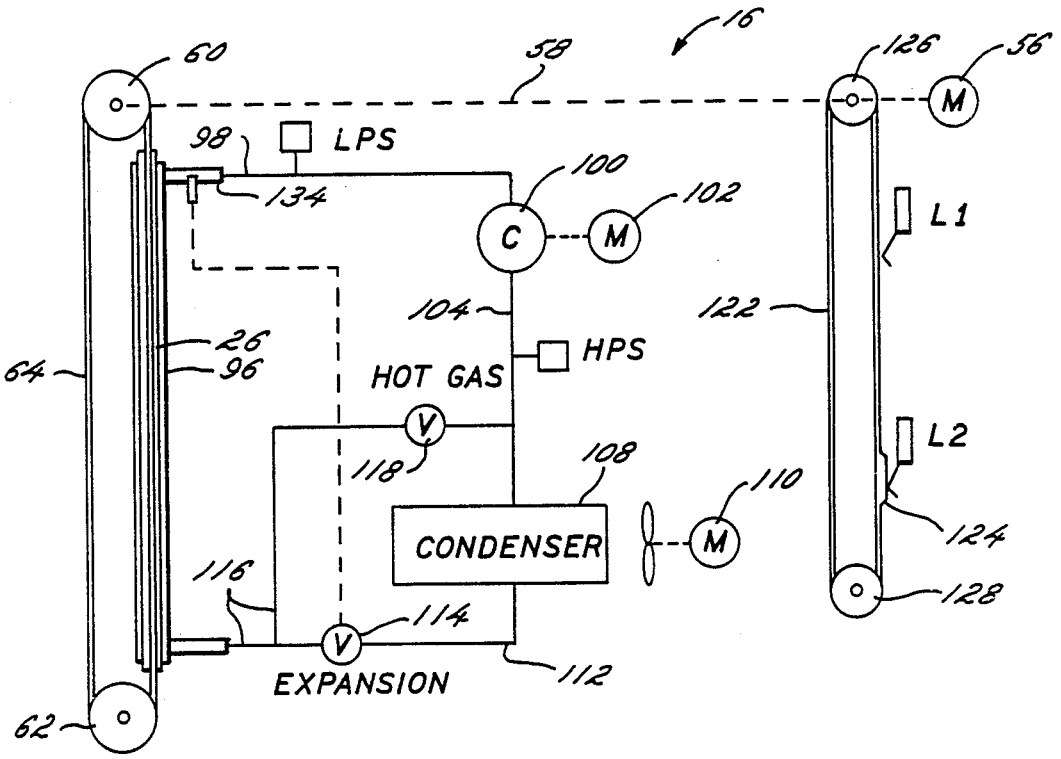
FIG. 7 is a schematic representation of the refrigeration system along with the cam belt and limit switches.

Upper sheave 126 is coaxially mounted to drive shaft 58 for operation by gear motor 56, rotation of which rotates sheave 126, cam belt 122, and lower idler sheave 128 in a clockwise direction as viewed in FIGS. 3 and 7.

The operation of ice machine 10 is best understood with reference to FIGS. 7 and 8 in addition to the other drawing figures. In operation, water system 22 maintains the water level in tubes 26, 28 at the level of float valve mechanism 50 as explained above.

Ice machine 10 is conventionally plugged into a standard 115 V.A.C power supply and conventionally provided with an on-off switch 132 (schematically illustrated in FIG. 8). With switch 132 closed, compresser motor 102 is energized and compressor 100 begins recirculating refrigerant through line 104, condenser 108, discharge line 112, expansion valve 114, inlet line 116, evaporator 96, suction line 98, and back to the inlet of compresser 100. The operation of expansion valve 114 is conventionally controlled by a temperature probe 134 (schematically illustrated in FIG. 7) which automatically opens expansion valve 14 with an increase in refrigerant temperature in suction line 98. When the system initially begins its cooling cycle, the pressure in suction line 98 is above the set point of low pressure switch (LPS) connected to suction line 98, and switch LPS is open. Additionally, at the beginning of the cycle, upper limit switch L1 is in its normally closed position and limit switch L2 is actuated to its open position by cam 124. As a result, relays R1, R2, gear motor 56, and hot gas valve are deenergized. High pressure switch (HPS) controls fan motor 110 so that a rise in discharge pressure from compressor 100 closes switch HPS at the set-point pressure to energize fan motor 110 according to conventional practice.

As refrigerant continues to cycle through refrigeration system 16, the refrigerant in evaporator 96 cools exterior surface 36 of freezing tube 26. As a result, the column of water contained therein cools and then freezes to form ice column 136 within tube 26 surrounding harvesting portion 92 of harvesting loop 64. As the ice column forms, it conforms to the shape of harvesting loop 64 and thus also conforms to the shape of support grooves 90. In so doing, ice column 136 is mechanically attached to harvesting portion 92. Additionally, as ice column 136 forms and expands slightly, it slightly compresses harvesting portion 92 thereby preventing any excessive strain on freezing tube 26.

During the course of the freezing cycle, which takes about five minutes in the preferred embodiment, the pressure in suction line 98 gradually drops until it reaches the set point of switch LPS. This set point coincides with formation of a fully formed ice column 136. In the preferred embodiment, switch LPS is set at about 5 PSIG, which would need to be adjusted for the particular embodiment of ice machine 10 and for the particular ambient conditions. When the pressure in suction line 98 drops below the set point, switch LPS closes, this energizes relay coil R1 and closes relay contacts R1*a* and R1*b*. Contact R1*a* latches in relay coil R1 via closed limit switch L1.

Closed relay contact R1*b* energizes hot gas valve 118 which opens to bypass hot gas around condenser 108 and expansion valve 114 in order to supply hot gas directly through evaporator inlet line 116 to evaporator 96. The hot gas in evaporator 96 warms freezing tube 26 which loosens ice column 136 adjacent interior surface 38 to allow easy withdrawal of column 136 from freezing tube 26.

When hot gas valve 118 is energized, conventional solid-state, time delay, switch TD is also energized which, in the preferred embodiment, is set to time for about 20 seconds after which switch TD closes to energize relay coil R2 via limit switch L1 and relay contact R1*b*. When relay coil R2 is energized, relay contact R2*a* closes to energize gear motor 56.

Figure 6:
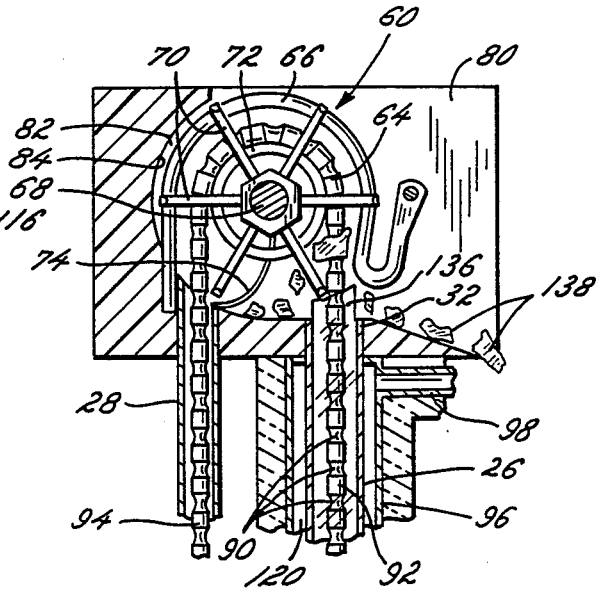
FIG. 6 is another view of the harvesting mechanism in partial section with portions cut away for clarity.

With gear motor 56 energized, harvesting pulley 60 begins to rotate counterclockwise, as viewed in FIG. 6, and begins to withdraw ice column 136 upwardly through upper end 32 of freezing tube 26.

As ice column 36 rises upwardly, the upward edge thereof, as viewed in FIG. 6, engages the nip between support ring 72 and loop 64 and prongs 70. As this happens, ice column 136 is forced to the right into engagement with ice breaking element 66. At the same time, harvesting portion 92 begins to curve about the support ring 72. These events result in fracture of that portion of column 136 extending above upper end 32 to form ice chips 138. As ice chips 138 form, some may fall onto curved portion 84 below harvesting pulley 60. In this location, wipers 74 periodically brush chips 138 rightwardly on either side of column 136.

As gear motor 58 rotates, drive shaft 58 also rotates upper sheave 126 causing cam belt 122 to rotate in a clockwise direction as viewed in FIGS. 3 and 7. Initially, as cam 124 disengages limit switch L2, limit switch L2 closes and latches in gear motor 56. As cam belt 122 continues to rotate around lower sheave 128 and then around upper sheave 126, it eventually engages upper limit switch L1. When this occurs, limit switch L1 opens and deenergizes relay R1 (switch LPS opened immediately after hot gas valve 118 was energized because of the increased pressure on suction line 98 caused thereby).

With relay R1 deenergized, relay contact R1*b* opens to deenergize hot gas valve 118 and also time delay switch TD (such as a Dayton ZA562X5 "cube timer") and relay R2. With gas valve 118 deenergized, refrigerant again passes through condenser 108 and expansion valve 114 to begin cooling in evaporator 96.

With relay coil R2 deenergized, relay contact R2*a* opens but gear motor 56 remains energized through limit switch L2. Thus, gear motor 56 continues to rotate cam belt 122 and harvesting loop 64 until cam 124 engages lower limit switch L2. When this occurs, limit switch L2 opens and deenergizes gear motor 56 which marks the end of the harvesting cycle. One complete revolution of cam belt 122 corresponds to rotation of harvesting loop 64 sufficient to fully withdraw harvesting portion 92 and thus ice column 136 from freezing tube 26.

The control scheme as described above is particularly advantageous in providing maximum ice chip production. This maximization is accomplished in large part by reinitiating the flow of cold refrigerant to evaporator 96 even before ice column 136 is fully withdrawn from freezing tube 26. This has the effect of precooling the water in freezing tube 26 that replaced ice column 136 as it was withdrawn from freezing tube 26.

As a matter of design choice, a conventional bin switch 140 can be included in series with compressor motor 102 to shut off ice machine 10 when the ice storage bin is full.

Other Embodiments

Figure 9:
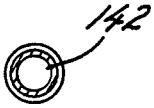
FIG. 9 is an cross-sectional view of a second embodiment of the harvesting member.

FIG. 9 illustrates a cross-sectional view of harvesting member 142 which is similiar to harvesting member 64 except that harvesting member 142 is hollow. That is to say, harvesting member 142 is in the shape of a tubular loop preferably composed of neoprene rubber or other flexible resilient material. The hollow nature of harvesting member 142 allows it to more readily compress and thereby relieve any strain on freezing tube 26 which may occur when the water therein freezes and expands. As is well known, water expands upon freezing and the ice column formed in freezing tube 26 may in time cause metal fatigue cracks or distortions. The hollow nature of harvesting tube 142 allows it to compress instead to take up the expansion in the ice column thereby preventing stress on the freezing tube.

Figure 10:
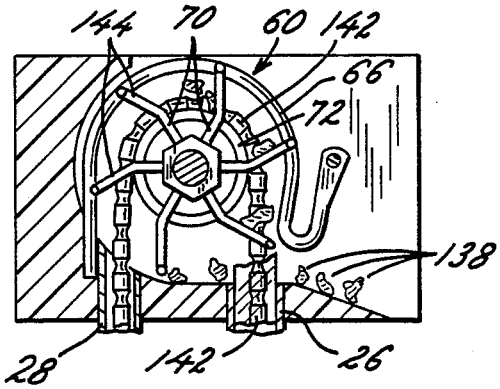
FIG. 10 is a view of the harvesting mechanism similar to FIG. 6 but showing the second embodiment of the harvesting member.

The hollow nature of harvesting member 142 provides another advantage as illustrated in FIG. 10 in that as harvesting member 142 rides over harvesting pulley 60, it flattens somewhat and this distortion aids in breaking the ice therefrom.

Figure 11:
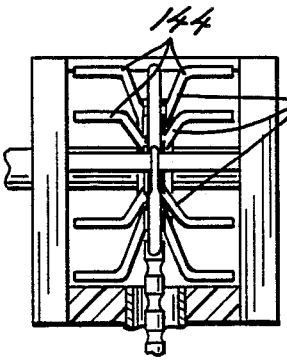
FIG. 11 is a view similar to FIG. 5 but showing a second embodiment of the prongs.

FIG. 11 illustrates another preferred embodiment of prongs 70 which shows each prong having an outwardly extending extension piece 144. Extension pieces 144 serve two functions. First, they prevent harvesting member 64 or 142 from escaping from the V-shaped confines defined by prongs 70. That is to say, if ice were to buildup under harvesting member 64 or 142, the member might ride up of the side of prongs 70 and slip over the tips thereof. The provision of extension piece 144 prevents this from occuring and helps guide harvesting member 64 or 142 back into the V-shaped space defined by prongs 70.

FIG. 10 also illustrates another embodiment in which prongs 70 along with extension pieces 144 are pitched about 30° forwardly in the direction of rotation. This is desirable to add additional mechanical advantages in breaking the ice column into chips or flakes. Additionally, extension pieces 144 sweep ice chips 138 forwardly, thereby functioning in a manner similar to wipers 74. That is to say, with extension pieces 144 it is possible to eliminate wiper 74 so that the sweeping action is provided by extension pieces 144.

Those skilled in the art will appreciate that the invention hereof encompasses many variations in the preferred embodiment described herein. For example, the size and capacity of ice machine 10 including the components thereof can be scaled upwardly or downwardly as a matter of design choice to provide the desired ice making capacity and speed. For example, in addition to increasing the dimensions of the harvesting system components, additional harvesting systems could also be provided in a multiplex arrangement thereby increasing the capacity of the system without adding an additional refrigeration system. That is to say, the refrigeration system could be increased in size sufficient to handle additional harvesting systems.

Additionally, harvesting loop 64 could include a flexible chain instead of the somewhat resilient neoprene "O-ring" structure which is preferred. Also, interior surface 38 of freezing tube 26 might be coated with TEFLON to aid the withdrawal of ice column 136, which might allow shortening of the hot gas cycle or elimination thereof to shorten total cycle time thereby increasing the capacity of ice machine 10. As a further example, those skilled in the art will appreciate that cam belt 122 and its associated components could be replaced by cams directly attached to drive shaft 58 or a separate camming arrangement used to actuate switches, counters, or the like. Furthermore, the present invention encompasses an embodiment in which the harvesting member is in the nature of an upright rod and the harvesting mechansim alternately raises the rod for breaking the ice column therefrom and then lowers the rod for production of another ice column. Finally, those skilled in the art will appreciate that various mechanical arrangements can be used to break ice column 136 as it emerges rather than the preferred prongs, support rings, and ice breaking element.

Having thus described the preferred embodiment of the present invention, the following is claimed as new and desired to be secured by Letters Patent:

1. In an ice machine including a refrigeration system operable to supply cold refrigerant to a selected location, the improvement comprising:

an upright, elongated, tubular body presenting an exterior surface and an upper end;

means for filling said body with water from a source thereof to a selected level;

an ice harvesting member comprising an endless loop of flexible material and presenting an elongated harvesting portion located within said tubular body and extending substantially along the length thereof;

means for selecting applying the cold refrigerant to said exterior surface of said tubular body in order to freeze the water contained therein to form a column of ice frozen to and thereby attached to said harvesting portion; and an ice harvesting mechanism including means coupled with said harvesting member for withdrawing said harvesting portion and thereby said column of ice attached thereto through said upper end, said withdrawing means including pulley means rotatably mounted in the vicinity of said upper end coupled with said harvesting member for rotation of said member around the path defined by said loop for withdrawing said harvesting portion from said tubular body, and said pulley means presenting a peripheral surface including a plurality of outwardly extending prongs for breaking said column of ice, said pulley means being rotatable about an axis of rotation, each of said prongs including respective outwardly extending extension pieces coupled with the distal ends thereof, said extension pieces extending generally parallel to said axis of rotation.

2. The ice machine as set forth in claim 1, said harvesting member presenting a circular cross-sectional configuration and further presenting a plurality of spaced-apart annular grooves defined on the surface thereof.

3. The ice machine as set forth in claim 1, said ice machine further including an upright return tube spaced apart and generally parallel to said tubular body, a connecting section interconnecting the respective lower ends of said return tube and said tubular body, said connecting section having walls defining a chamber therein for fluidic communication between said return tube and said tubular body, said harvesting member extending through said return tube, said chamber, and said tubular body, and around said pulley means for endless passage thereabout.

4. The ice machine as set forth in claim 3, said ice machine further including means for automatically and periodically flushing said chamber in order to prevent build up of solids therein.

5. The ice machine as set forth in claim 1, further including control means coupled with said withdrawing means for sensing when said ice column is formed for automatically activating said withdrawing means in response thereto.

6. The ice machine as set forth in claim 1, said refrigeration system including means for applying hot refrigerant gas to a selected location, said ice machine further including means for selectively applying hot gas to said exterior surface after said ice column is formed in order to loosen said ice column from the interior surface of said body.

7. A method of producing ice chips in an ice machine having the capability of applying cold refrigerant to a selected location, said method comprising the steps of:

providing an upright, elongated, tubular body presenting an exterior surface and an upper end;

filling said tubular body with water from a source thereof to a selected level;

providing an ice harvesting member having an elongated harvesting portion located within said tubular body and extending substantially along the length thereof;

applying cold refrigerant to said exterior surface in order to freeze the water contained in said tubular body to form an ice column frozen to and thereby attached to said harvesting portion;

sensing when said ice column is formed and automatically withdrawing said harvesting portion and said ice column through said upper end in response thereto; and fracturing said ice column after emergence from said tubular member in order to detach said column from said harvesting portion and in order to produce ice chips from said ice column.

8. The method as set forth in claim 7, said refrigeration system including means for applying hot refrigerant gas to a selected location, said method further including the steps of applying hot gas to said exterior surface after the formation of said ice column in order to loosen said ice column from the interior surface of said body.

9. In an ice machine including a refrigeration system operable to supply cold refrigeration to a selected location, the improvement comprising: a body having walls defining an ice-forming chamber therewithin; means for selectively delivering water to said chamber; means for freezing water within said chamber to form ice therein; means for harvesting ice from said chamber after formation of ice therein, said ice harvesting means including an elongated harvesting element disposed within said chamber for adhering ice thereto after ice is formed in said chamber, means operably coupled with said harvesting element for causing said harvesting element to remain in an essentially stationary condition within said chamber during at least a portion of the time for freezing the water therein and for shifting said harvesting element at least partially out of said chamber after ice is formed and has adhered to said harvesting element.

10. The ice machine as set forth in claim 9, further including control means operably coupled with said means for shifting the element out of said chamber for sensing when said ice is formed to activate said shifting means in response thereto.

11. The ice machine as set forth in claim 9, said refrigeration system including means for applying hot refrigerant gas to a selected location of said body to loosen said ice from said ice-forming chamber.

12. In an ice machine including a refrigeration system having the capability of supplying cold refrigerant to a selected location, the improvement comprising:

an upright, elongated, tubular body presenting an exterior surface and an upper end;

means for filling said body with water from a source thereof to a selected level;

an ice harvesting member presenting an elongated harvesting portion located within said tubular body and extending substantially along the length thereof such that when said body is filled with water to said selected level, the water substantially surrounds said harvesting portion;

means for selectively applying the cold refrigerant to said exterior surface of said tubular body in order to freeze the water contained therein to form a column of ice frozen to and thereby attached to and in substantially surrounding relationship with said harvesting portion; and an ice harvesting mechanism including means coupled with said harvesting member for withdrawing said harvesting portion and thereby said column of ice attached thereto through said upper end.

13. The ice machine as set forth in claim 12, said harvesting member including an endless loop of flexible material, and said withdrawing means including pulley means rotatably mounted in the vicinity of said upper end and cooperable with with said harvesting member for rotation of said member around a path defined by said loop for withdrawing said harvesting portion from said tubular body.

14. The ice machine as set forth in claim 13, said pulley means including structure for deforming said harvesting portion into curved configuration with the shape of said pulley means in order to fracture said ice column.

15. The ice machine as set forth in claim 13, said ice machine further including an upright return tube spaced apart and generally parallel to said tubular body, a connecting section interconnecting the respective lower ends of said return tube and said tubular body, said connecting section having walls defining a chamber therein for fluidic communication between said return tube and said tubular body, said harvesting member extending through said return tube, said chamber, and said tubular body, and around said pulley means for endless passage thereabout.

16. In an ice machine including a refrigeration system having the capability of supplying cold refrigerant to a selected location, the improvement comprising:

an upright, elongated tubular body presenting an exterior surface and an upper end;

means for filling said body with water from a source thereof to a selected level;

an ice harvesting member presenting an elongated harvesting portion located within said tubular body and extending substantially along the length thereof;

means for selectively applying the cold refrigerant to said exterior surface of said tubular body in order to freeze the water contained therein to form a column of ice frozen to and thereby attached to said harvesting portion; and an ice harvesting mechanism including means coupled with said harvesting member for withdrawing said harvesting portion and thereby said column of ice attached thereto through said upper end, and control means coupled with said withdrawing means for sensing when said ice column is formed for automatically activating said withdrawing means in response thereto.

17. The ice machine as set forth in claim 16, said refrigeration system including means for applying hot refrigerant gas to a selected location, said ice machine further including means for selectively applying hot gas to said exterior surface after said ice column is formed in order to loosen said ice column from the interior surface of said body.

18. A method of producing ice in an ice machine having the capability of applying cold refrigerant to a selected location, said method comprising the steps of:

providing an upright, elongated, tubular body presenting an exterior surface and an upper end;

filling said tubular body with water from a source thereof to a selected level;

providing an ice harvesting member having an elongated harvesting portion located within said tubular body and extending substantially along the length thereof such that the water substantially surrounds said harvesting portion;

applying the cold refrigerant to said exterior surface in order to freeze the water contained in said tubular body to form an ice column frozen to and thereby attached to and in substantially surrounding relationship with said harvesting portion;

withdrawing said harvesting portion and said ice column attached thereto through said upper end.

19. The method as set forth in claim 18, further including the steps of sensing when said ice column is formed and automatically withdrawing said harvesting portion in response thereto.

20. The method as set forth in claim 18, said refrigeration system including means for applying hot refrigerant gas to a selected location, said method further including the step of applying hot gas to said exterior surface after the formation of said ice column in order to loosen said ice column from the interior surface of said body.

21. An ice making machine comprising:

a body having walls defining an ice-forming chamber therewithin;

means for selective delivery of water to said chamber;

an elongated ice harvesting element disposed within said chamber in spaced relationship to at least certain of said chamber-defining walls and located and adapted for adherence of ice thereto;

means for freezing water within said chamber including structure for supplying refrigerant exteriorly of said chamber such that the ice initially forms adjacent some of the chamber-defining walls located in spaced relationship to said element and such that subsequent ice formation thereafter builds up towards said element until the ice is adhered thereto;

means operably coupled with said element for shifting said element at least partially out of said chamber with ice adhered thereto after formation of the ice.

* * * * *